United States Patent [19]

Schild et al.

[11] 4,391,009

[45] Jul. 5, 1983

[54] VENTILATED BODY SUPPORT

[75] Inventors: Rolf Schild; Denis G. Melrose, both of London; Brian M. Hawkins, Luton, all of England

[73] Assignee: Huntleigh Medical Ltd., Bedfordshire, England

[21] Appl. No.: 198,111

[22] Filed: Oct. 17, 1980

[51] Int. Cl.[3] ..... A61G 7/04; A47C 27/10

[52] U.S. Cl. ..... 5/453; 5/455; 5/469; 297/180

[58] Field of Search ..... 5/453–456, 5/469, 423; 297/180, 453

[56] References Cited

U.S. PATENT DOCUMENTS

| | | | |
|---|---|---|---|
| 2,782,834 | 2/1957 | Vigo | 297/180 |
| 3,148,391 | 9/1964 | Whitney | 5/456 |
| 3,266,064 | 8/1966 | Figman | 5/423 |
| 3,486,177 | 12/1969 | Marshack | 5/469 |
| 3,653,083 | 4/1972 | Lapidus | 5/469 |
| 3,681,797 | 8/1972 | Messner | 5/469 |
| 3,757,366 | 9/1973 | Sacmer | 5/423 |
| 3,920,006 | 11/1975 | Lapidus | 128/40 |
| 4,149,286 | 4/1979 | Fogel | 5/451 |
| 4,225,989 | 10/1980 | Corbett et al. | 5/469 |
| 4,305,168 | 12/1981 | Holter et al. | 5/469 |

FOREIGN PATENT DOCUMENTS

| | | | |
|---|---|---|---|
| 1334935 | 10/1973 | United Kingdom | 5/456 |

*Primary Examiner*—Alexander Grosz

*Attorney, Agent, or Firm*—Pennie & Edmonds

[57] ABSTRACT

Disclosed is a ventilated support for living bodies comprising an inflatable alternating pressure pad which is either enclosed by or forms a part of an air permeable plenum chamber through which air is pumped at low pressure to provide a source of ventilating air to a body resting on the support. The alternating pressure pad which is inflated by a high pressure pump has two sets of interdigitated cells which are alternately inflatable and deflatable and carry the weight of a body, alternately, on each of the two sets of cells. The plenum chamber is provided with a separate low pressure air pump which passes through the air permeable upper element of the plenum chamber to reduce moisture build-up and otherwise cool the body resting on the support. In the embodiment in which the alternating pressure pad forms the upper element of the plenum chamber, it is provided with a plurality of apertures which are sealed from the alternating pressure cells to prevent the loss of pressure therein.

13 Claims, 6 Drawing Figures

VENTILATED BODY SUPPORT

FIELD OF THE INVENTION

This invention relates to ventilated body supports which can reduce or eliminate the physical discomfort or injury that occurs when a living body rests immobile on a support for extended periods of time. In certaion occupations, such as truck driver or airline pilot, where persons are confined to their seats for prolonged periods, discomfort and pain often results. More serious physical injury occurs in the case of patients who, because of chronic illness or serious physical disability, are confined to bed for extended periods of time on ordinary mattresses. This causes breakdown of the skin tissue due to interruption of the blood flow, a condition known as decubitus ulcers or bedsores.

It has been known for some time that the occurrence of decubitus ulcers can be prevented or reduced by the use of mattress or pad which has interleaved inflatable portions that can be inflated alternately so that the part of the person's body which rests on the support varies from time to time. The reason for this is that contact between the patient's body and the support is periodically relieved and transferred which permits increased blood flow to the pressure points where the patient's weight is supported. These inflatable supports are known as alternating pressure pads and they have found extensive use in hospitals and nursing homes in connection with the care of patients who are unable to move their bodies. However, a build-up of moisture between the patient and the support caused by sweating, incontinence, etc. can still cause bedsores and contribute to general physical discomfort of a patient. Moisture build-up is also a problem in connection with supports other than alternating pressure pads of the type mentioned above.

Attempts have been made to reduce moisture build-up by providing ventilating air between the patient and the supporting pad. Examples of these types of devices are described in Whitney U.S. Pat. No. 3,148,391 and Lapidus U.S. Pat. No. 3,653,083. U.S. Pat. No. 3,148,391 describes an alternating pressure pad having ventilating holes formed in the seal ribbon between the interleaved pressure cells. In this device there is no active air flow between the patient and the support nor is there any means for pumping or moving air through the ventilating holes. Lapidus U.S. Pat. No. 3,653,083 describes a type of alternating pressure device in which perforations are provided in the expandable alternating pressure cells so that air escapes therefrom and flows between the patient and the support. Since the cells are perforated, an oversized pump is required to provide both inflation of the cells and air flow therethrough. Otherwise, the cells will deflate and the patient will be subject to continuous bodily pressure while resting on the pad. Moreover, in an apparatus of this type, the escape velocity of the air from the inflatable cells is so high that the escape air has to be diffused by inserting an air permeable pad between the patient and the support.

One aspect of the present invention comprises an inflatable alternating pressure pad enclosed within or forming a part of a plenum chamber which provides a supply of ventilating air to the patient. In this embodiment a high pressure supply is provided for inflating the alternating pressure pad and a low pressure pumping means for pumping air into the plenum chamber or, alternatively, for drawing air into the chamber from the outside by the application of suction. The plenum chamber comprises upper and lower elements sealed together with the upper element being air permeable or having numerous apertures for the passage of air. With this arrangement separate air supplies at different pressures are provided to the alternating pressure pad and to the plenum chamber. The high and low pressure supplies can be separately adjusted for optimum performance of both the alternately inflating cells and ventilating plenum chamber.

In another embodiment of the device the alternating pressure pad itself may constitute one of the elements of the plenum chamber. For example, it may form either the lower element or the upper element of the plenum chamber in conjunction with another part. If it forms the upper element it will have a plurality of apertures between the cells and sealed therefrom, for the escape of ventilating air.

Conveniently, the upper and lower elements may be made of thermoplastic sheet materials which are sealed together by welding or, where desired, fastened by means of air tight fasteners such as certain types of zippers. Further, when the upper element is not formed by the alternating pressure pad itself, it may be made from an air permeable material or made permeable to air by providing therein a plurality of ventilating holes.

Preferably, the inlet, or outlet in the case of operation by suction or vacuum, of the plenum chamber is at an edge of the support and comprises a rigid air conduit portion extending from outside to inside the chamber. The outer end is adapted for connection to the supply or suction pipe with the axis extending substantially at right angles to the adjacent edge of the support. The inner end extends into the interior of the chamber in a plane substantially at right angles to the adjacent edge of the support. Conveniently, the air conduit portion is T-shaped with the upright of the T extending from the outside to the inside of the chamber at an angle perpendicular to the adjacent edge of the support. The cross-bar of the T communicates with the inner end of the upright and extends parallel to the edge of the support providing a pair of interior apertures.

Normally, the high pressure supply for the alternating pressure pad, provides air at between 30 and 90 mm of mercury. In one arrangement, the alternating pressure pad has two interleaved or interdigitated sets of channels forming the sets of inflatable cells. Then each channel may be formed as a series of intercommunicating bubble shaped cells, with the bubble cells of one channel being interspersed between the bubble cells of each adjacent channel.

The low pressure pumping means is preferably arranged to pump air into the plenum chamber. A bacterial filter may be included between the pumping means and the inlet to the plenum chamber. The low pressure pumping means may deliver air at a pressure not more than 5 mm of mercury and, typically, 0.2 mm to 1 mm of mercury. If desired, the low pressure system can be arranged so as to pull air of the plenum chamber by suction which, in turn, will draw air from the outside through the air permeable upper layer of the plenum.

In another aspect, the present invention provides a ventilating support comprising a noninflatable support pad, an envelope surrounding the support pad, the upper side of the envelope being air permeable and low pressure pumping means for pumping air into the envelope or for drawing air from the outside into the envelope by means of suction. With this arrangement, an existing support pad, which may be an ordinary mattress, can be converted into a ventilating pad.

DETAILED DESCRIPTION OF THE DRAWINGS

The invention will be fully understood by those skilled in the art from the following description and drawings in which.

DETAILED DESCRIPTION OF THE INVENTION

Figure 1:
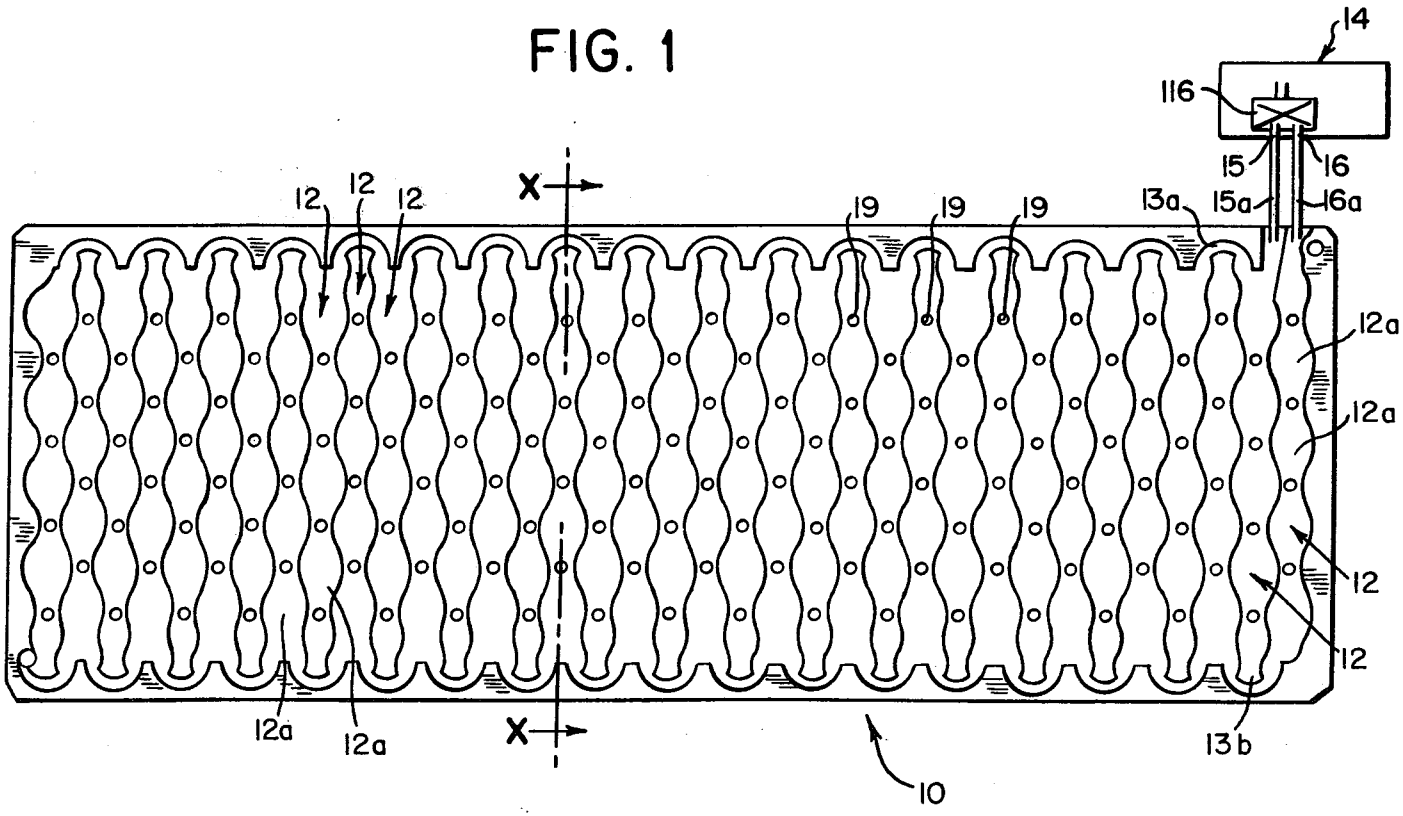
FIG. 1 is a plan view of a support constituting one embodiment of the invention.
Figure 2:
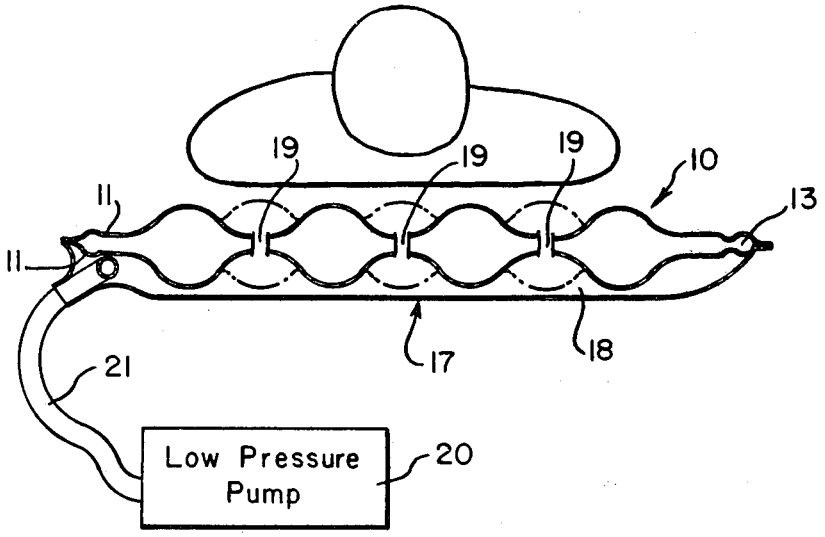
FIG. 2 is a cross-sectional view along the line X—X of FIG. 1, and showing a patient in position.

FIGS. 1 and 2 show a support pad for use as a mattress on a bed. The support is generally indicated at 10, and comprises a pair of overlying plastic sheets 11, which are hermetically sealed together to define two sets of channels 12 which are interdigitated, each channel having a closed end and an open end. Each channel 12 comprises a series of aligned generally spherical bubble-like cells 12*a*. In this particular embodiment the channels extend in directions transverse to the length of the mattress. The channels 12 extend across the center portion of the width of the pad, leaving edge portions of sheets 11 extending lengthwise of the mattress and defining two air supply manifolds 13*a* and 13*b*, one on each side of the mattress. One set of channels has the open ends of the channel open to manifold 13*a* and the other set has open ends open to manifold 13*b*.

An air pump 14 has outputs 15 and 16. Output 15 is connected to manifold 13*a* by input tube 15*a* and output 16 is connected to manifold 13*b* by input tube 16*a*. Valve means 116 are provided in the pump to supply air under pressure from the pump alternately to the two manifolds 13*a* and 13*b* and hence to cause adjacent channels 12 to be inflated and deflated alternately. The valve means are arranged so that the channels of one set are inflated or at least partially inflated before the channels of the other set are deflated.

The two sets of channels 12 thus form an air pad giving support to a user in which the weight of the user is carried alternately on discrete regions defined by the two sets of channels.

An air impermeable sheet 17 is affixed to the lower side of the interconnected sheets 11 to form a plenum 18 therebelow. A series of apertures 19 are formed through the interconnected sheets 11 of the air pad, such that these apertures are sealed from the channels 12. A low pressure pump 20, typically a fan or blower supplying air at a pressure of 0.2 mm of mercury, is connected by a tube 21 to the plenum chamber 18. This pump is operated continuously to maintain a low pressure in the plenum chamber, the pressure being lower than that employed in the air pad supplied by the pump 14 and insufficient to support the weight of a user on the mattress.

The upper side of the pad 10 may be covered by a normal cotton bed sheet or other air permeable sheet.

In use the channels 12 are alternately inflated by the pump 14, which is controlled by a pressure regulator, (not shown) which enables adjustment to be made of the air pressure supplied to the channels 12 in accordance with the weight and shape of the patient. This pressure is typically between 30 and 90 mm of mercury and such that the weight of the user is carried on the inflated cells holding the patient away from the deflated cells. This ensures that the regions of contact between the user and the support change alternately with the alternate inflation of the two sets of channels.

Instead of blowing air into the plenum chamber 18 and hence out of the apertures 19, the pump 20 may be arranged to suck air from chamber 18 and hence cause air to flow from the environment through apertures 19 into plenum 18. Either way, air at a suitable pressure is passed between the pad and the user to ventilate the regions of contact between pad and user. Further, the pressure of the ventilating air is not dependent on the pressure in channels 12 and hence the weight or shape of the patient and, therefore, the pressure of the ventilating air can be selected solely on the basis of achieving correct ventilation. The low pressure air ventilation for the patient operates continuously. The amount of ventilation is controlled by the output of the pump 20 and is wholly independent of the pressure of the air supply to the pressure pad channels 12; the latter can be adjusted independently in accordance with requirements, e.g. the weight of the patient.

It will be appreciated that different arrays of apertures will be required depending on the use of the pad. However, for ventilation of the user to occur, at least some of the apertures must be formed in a part of the pad which lies beneath the user but is spaced from the user during at least one part of the cycle of pump 14. The size of the apertures will depend on the capacity of the low pressure pump 20 and the number of apertures, but the pump capacity and the aperture size should be chosen to be sufficient to achieve ventilation of the user without over inflating the plenum 18, and to avoid excessive ventilation and chilling of the user.

In the arrangement illustrated in FIG. 2, the alternating pressure pad 10 constitutes the upper element defining the plenum chamber 18 with the sheet 17 forming the lower elementt. In the alternative arrangement illustrated in FIG. 3, the pressure pad 10 itself forms the lower element of a plenum chamber defined between the support 10 and an upper sheet 22 sealed about the edge of the support 10. The upper sheet 22 is made air-permeable, for example, by providing apertures 23 through the sheet. In this example, the alternating pressure pad 10 is itself made impermeable, that is to say, the apertures 19 are omitted. Low pressure air is supplied from the pump 20 via a pipe 21 to the chamber 24 above the pad 10.

Figure 4:
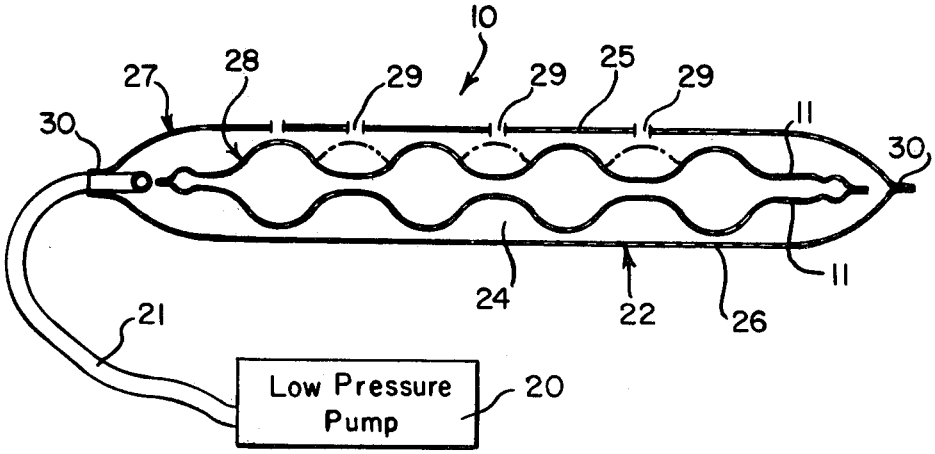
FIG. 4 is a cross-sectional view showing a further alternative embodiment of the invention.
Figure 5:
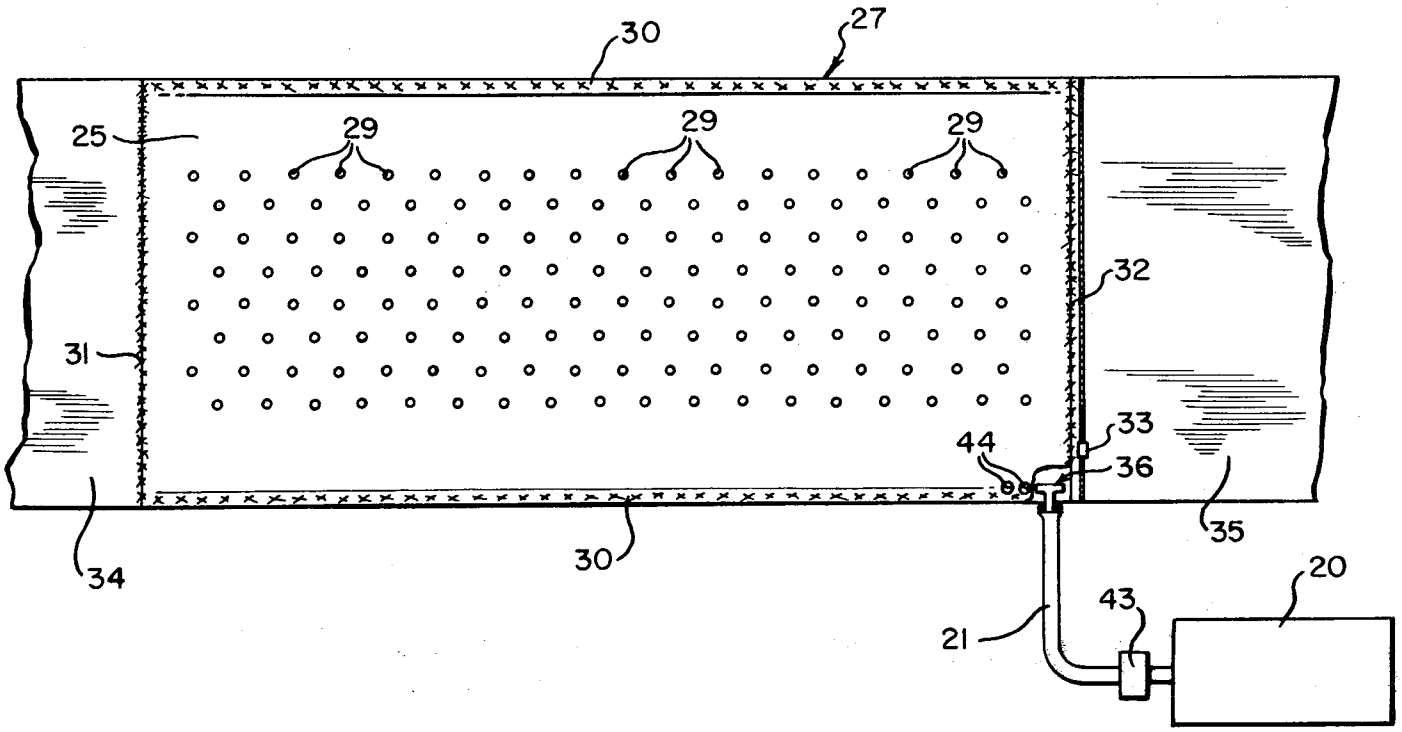
FIG. 5 is a plan view of the embodiment of FIG. 4.

Referring now to FIGS. 4 and 5, a further embodiment of the invention is illustrated. In this embodiment, a plenum chamber 24 is formed by upper and lower sheets 25 and 26 sealed together to form an envelope 27 containing the supporting pad 28. The envelope 27 is separate from the pad 28 and is supplied with low pressure air as before via a pipe 21 from a pump 20. The air in the envelope 27 can flow around the edges of the pad 28 and escape from the envelope via apertures 29 in the upper sheet 25. As shown in FIG. 4, the support pad 10 may, for example, be an alternating pressure pad of the sort described above. Thus, this embodiment of the invention enables existing alternating pressure pads to be converted to enable ventilating air to be supplied to the user by inserting such a pad inside the envelope 27.

It is not essential for the pad 28 to be of the alternating pressure type. Any support pad of the kind commonly used for supporting a user, e.g. a mattress, can be provided or inserted in the envelope 27. By using the envelope 27 with a supply of low pressure air from the pump 20, ventilating air can be supplied to the user supported on the pad.

A plan view of the envelope 27 is illustrated in FIG. 5. The upper and lower sheets 25 and 26 of the envelope are in this example made from a thermoplastic sheet material and are welded together along the side edges 30 and one end edge 31. The opposite end edge 32 is provided with closure means, for example, an airtight zipper-type fastener 33 by which the end can be closed as required after fitting the envelope around a supporting pad. It is contemplated that any of a variety of airtight quick-release fasteners may be used herein. The upper and lower sheets 25 and 26 may be extended at each end of the envelope beyond the end edges 31 and 32 to form flaps 34 and 35 respectively which can be used for locating and holding the complete envelope and enclosed supporting pad in position when in use, e.g. by tucking under an existing mattress on a bed.

A pair of grommetted holes 44 may be provided through top sheet 25 to allow the supply tubes 15*a* and 16*a* from pump 14 to be connected to an alternating pressure pad 10 in the envelope 27.

Figure 3:
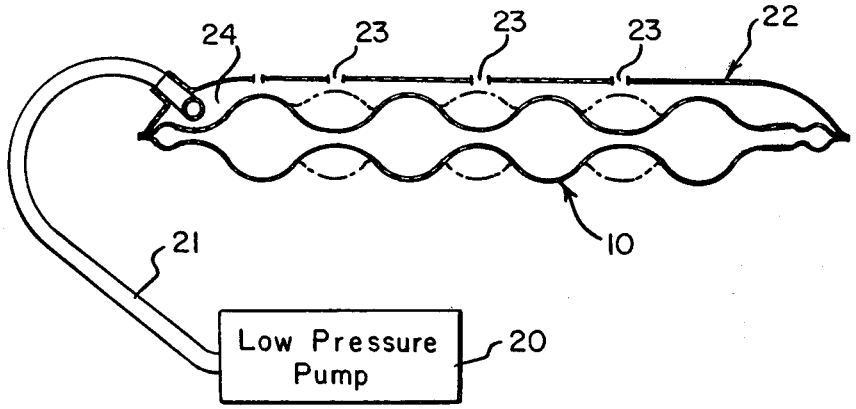
FIG. 3 is a cross-sectional view corresponding to that of FIG. 2 and showing an alternative embodiment of the invention.

Preferably, the upper and lower sheets 25 and 26 in the example of FIGS. 4 and 5, and also the undersheet 17 and oversheet 22 of the examples of FIGS. 2 and 3 of the invention are made of polyvinyl chloride sheet material, in which case these sheets are impermeable except for the plurality of apertures 23 and 29 which are punched therethrough. Instead, however, the upper sheets 22 in FIG. 3 and 25 in FIG. 4 may be made of an air permeable material to allow air to migrate through the material from the plenum chamber supplied with low pressure air from the pump 20.

Figure 6:
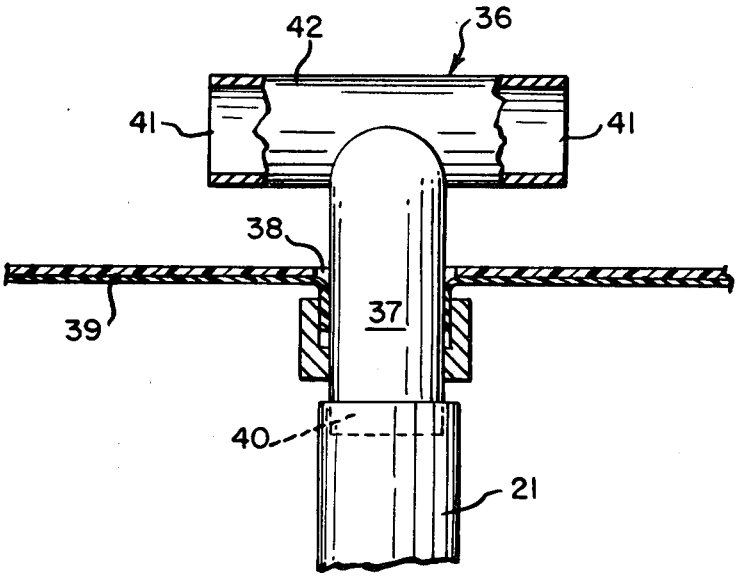
FIG. 6 is an enlarged view showing an inlet for low pressure air to the plenum chambers or envelope provided in any of the embodiments of FIGS. 1 to 5.

FIG. 6 illustrates a preferred inlet arrangement for the low pressure air delivered from the pump 20 to the plenum chamber formed in any of the examples shown in FIGS. 2 to 5. A T-shaped conduit member 36 is formed of a relatively rigid material, so as not to be crushed during normal use of the support pad. The upright 37 of the T passes through an aperture 38 provided in a side edge 39 of the envelope and is sealed to the border of the aperture 38 of the material of the envelope by any known means, such as by clamping as illustrated. The supply pipe 21 is connected to the outer end 40 of the upright 37 of the conduit 36 and extends as shown, at least initially, substantially at right angles to the adjacent edge 39 of the envelope. Air supplied along the pipe 21 enters the envelope and is emitted from the conduit 36 from the two ends 41 of the cross-bar 42 of the T and is thus emitted from the conduit 36 through apertures which lie in planes also at right angles to the edge 39. This arrangement minimizes the risk of the opening from the connector 36 into the interior of the plenum chamber being occluded by the material of the chamber or enclosed supporting pad.

A bacterial filter 43 (FIG. 5) may be included between the low pressure pump 20 and the inlet to the plenum chamber, conduit 36. This ensures that when ventilation is provided by pumping air into the plenum chamber, the risk of infection being caused by the ventilating air is minimized.

If desired, means may be provided for controlling the temperature of the ventilating air supplied to the plenum chamber or envelope.

It will be appreciated that the above-described constructions can be used to form a mattress to support the whole body of the user or alternatively to form any other kind of support, for example a driving seat for a truck or other road vehicle, airline seats, or seats for airplane pilots.

We claim:

1. A ventilated support for living bodies comprising:

a plenum chamber having a plurality of apertures for communication with the environment;

first pump means coupled to said plenum chamber for providing passage of air through said plenum chamber at a relatively low pressure;

alternating inflatable support means disposed in operative relationship to said plenum chamber and having a first set of aligned bubblelike cells which are interdigitated with a second set of aligned bubblelike cells for giving sole support to said living body; and second pump means coupled to said alternating inflatable support means for alternately inflating at a relatively high pressure said first and second interdigitated sets of aligned bubblelike cells.

2. A support according to claim 1 wherein said alternating inflatable support means forms the lower element of said plenum chamber.

3. A support according to claim 1 wherein said alternating inflatable support means forms the upper element of said plenum chamber and the plurality of apertures of said plenum chamber are disposed between said first and second interdigitated sets of aligned bubblelike cells and sealed therefrom to allow air to pass through said plenum chamber and prevent loss of pressure from said alternating inflatable support means.

4. A support according to claim 1, wherein said alternating inflatable support means is disposed within said plenum chamber which forms an envelope around said alternating inflatable support means.

5. A support according to claim 1, 2 or 4 wherein the upper element of said plenum chamber is made from an air permeable material.

6. A support according to claim 1 wherein said upper and lower elements of said plenum chamber are made of thermoplastic sheet material sealed together by welding, said upper element having therein a plurality of apertures to allow for the passage of air therethrough.

7. A support according to claim 1 wherein said upper and lower elements of said plenum chamber are sealed together, at least in part, by means of an airtight zipper-type fastener.

8. A support according to claim 1 wherein said inlet to said plenum chamber is at an edge of the support and comprises a rigid air conduit portion extending from outside to inside the plenum chamber and having an outer end adapted for connection to a supply or suction pipe with the pipe axis extending substantially at right angles to the adjacent edge of the support and an inner end having an aperture to the interior of the plenum chamber in a plane substantially at right angles to the adjacent edge of the support.

9. A support according to claim 1 wherein the inlet to said plenum chamber comprises a rigid T-shaped conduit in which the upright of the T extends from the outside to the inside of the plenum chamber perpendicular to the adjacent edge of the support and the crossbar of the T has apertures to the interior of the plenum chamber which extend parallel to the edge of said plenum chamber.

10. A support according to claims 8 or 9 which further includes a bacterial filter placed between said first pump means and the inlet to said plenum chamber.

11. A support according to claim 1 wherein said second pump means for inflating said inflatable support means is a high pressure pump capable of supplying air at between 30 and 90 mm Hg and said first pump means for pumping air to said plenum chamber comprises a low pressure pump capable of supplying air at a pressure of about 5 mm Hg or less.

12. A ventilated support for living bodies comprising:

a support pad;

an envelope, made from a flexible sheet material, having a plurality of apertures in its upper portion for communicating with the environment and having an airtight closure through which said support pad may be disposed within said envelope; and pump means coupled to said envelope for providing suction so as to draw air through said envelope at a pressure of about 5 mm Hg or less.

13. A support according to claim 12 wherein said closure includes an airtight zipper.

* * * * *